United States Patent [19]

Moller

[11] Patent Number: 4,572,703

[45] Date of Patent: Feb. 25, 1986

[54] APPARATUS FOR APPLYING TO A ROAD, RUN-WAY OR EQUIVALENT A POINT-FORMED OR DOTTED PAINT OR MARKING, ESPECIALLY A TRAFFIC INDICATION LINE

[75] Inventor: Jens Gert K. Moller, Hurup, Denmark

[73] Assignee: Superros Dammann-Luxol A/S, Frydenlundsvej, Vedbaek, Denmark

[21] Appl. No.: 683,414

[22] Filed: Dec. 19, 1984

[30] Foreign Application Priority Data

Jan. 9, 1984 [DK] Denmark ..... 76/84

[51] Int. Cl.[4] ..... E01C 23/16

[52] U.S. Cl. ..... 404/94; 427/137; 118/305

[58] Field of Search ..... 404/9, 12, 14, 16, 93, 404/94; 118/300, 305; 427/136-138; 222/148, 342

[56] References Cited

U.S. PATENT DOCUMENTS 4,373,670 2/1983 Kilner ..... 404/93 X

FOREIGN PATENT DOCUMENTS 1211690 11/1970 United Kingdom ..... 404/93

*Primary Examiner*—James A. Leppink
*Assistant Examiner*—John F. Letchford
*Attorney, Agent, or Firm*—Holman & Stern

[57] ABSTRACT

The apparatus for applying to a road, (1), run-way or equivalent a point-formed or dotted paint or marking (M″), especially a traffic indication line comprises a reservoir (R) containing a supply of highly viscous material (M) to be applied to the road (1) and a nozzle section (10,10′) in itself comprising conduits (11) ending in orifice zones (11′,11″) for forming preliminary stages (M′) of highly viscous drops and means (20,20′,20″) for flinging the drops down into engagement with the road (1).

In a mechanical embodiment the orifice zones (11′) of the conduits (11) are placed on a cylinder surface (12) and are mutually separated by means of partition walls (13) and the means (20) for flinging the material down into engagement with the road comprise a rotatory shaft (21) and a number of shovel blades (22).

In a pneumatic embodiment the means (30) for flinging the drops down into engagement with the road (1) comprise a plurality of compressed air tubes (20′) each leading to an orifice zone (11″) and another plurality of tubes (20″) leading away from the said zone ('11″).

These apparatus constitute simple and cheap embodiments of an apparatus which effectively flings the marking mass into contact with the road.

4 Claims, 6 Drawing Figures

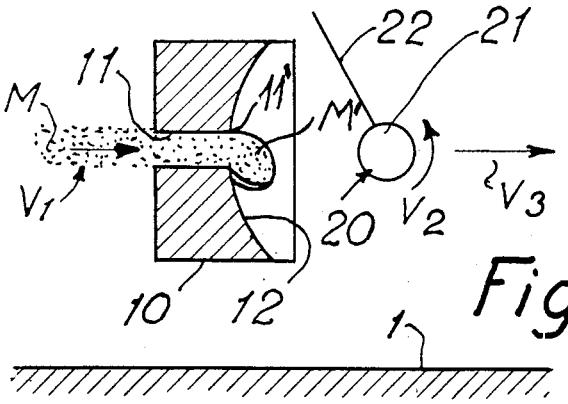
Fig. 1
Fig. 2
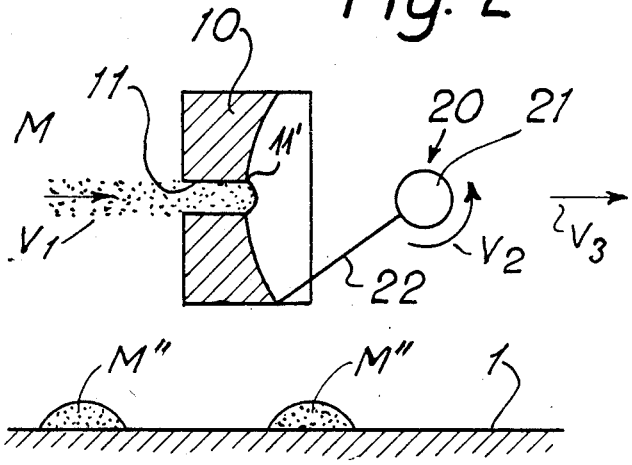

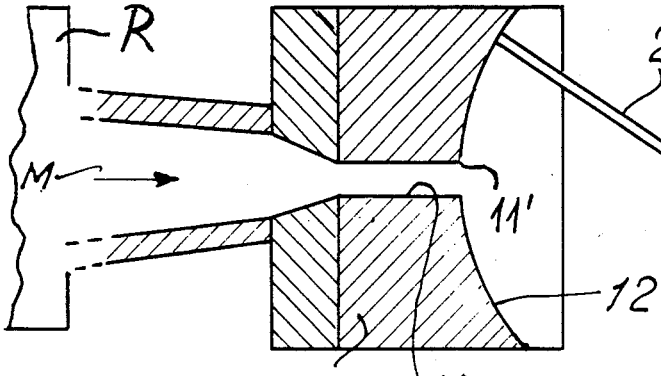
Fig. 3
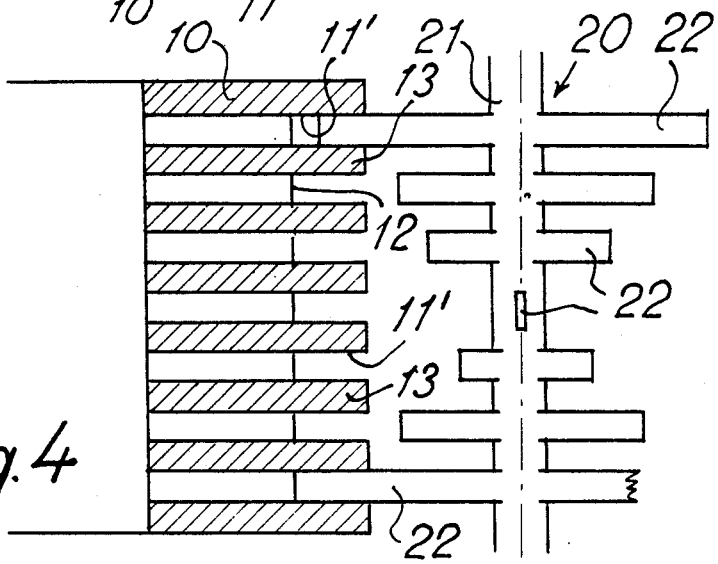
Fig. 4
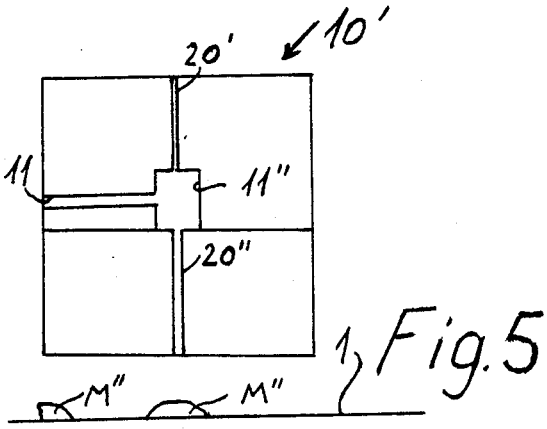
Fig. 5
Fig. 6
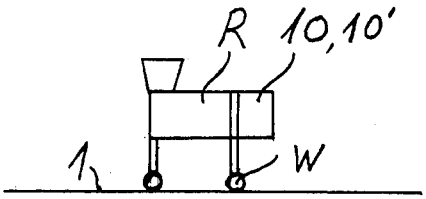

APPARATUS FOR APPLYING TO A ROAD, RUN-WAY OR EQUIVALENT A POINT-FORMED OR DOTTED PAINT OR MARKING, ESPECIALLY A TRAFFIC INDICATION LINE

This invention relates to an apparatus for applying to a road, run-way or equivalent a point-formed or dotted paint or marking, especially a traffic indication line.

By applying a traffic indication line in a point-formed pattern one obtains in comparison to a continuous line both a material saving and the production of a very important number of small material areas; when the material contains reflex-reflecting material the reflex-reflecting effect will be multiplied. Furthermore rain water will more easily be able to run away.

The known apparatus for preparing profiled markings are substantially based upon three methods:

(1) One pushes part of the applied mass together in wave-formed beads across the line. This has certain drawbacks: the mass between the beads will not be completely removed so that the water will not run freely between the beads, and since the beads are arranged at regular intervals this can give rise to an undesired noise.

(2) One applies an ordinary stripe and then presses a pattern down into the mass. It is true that this can produce many surfaces but the water cannot run away.

(3) One transfers a marking mass or a paint to the road by means of a template which, however, will quickly be worn down and will therefore have to be changed.

The purpose of the invention is to suggest an apparatus for applying a marking in which the above-mentioned drawbacks are avoided.

The apparatus of the invention is characterized by the fact that it comprises a reservoir containing a supply of highly viscous material to be applied to the road and a nozzle section in itself comprising conduits ending in orifice zones for forming preliminary stages of highly viscous drops and means for flinging the drops down into engagement with the road.

The advantages of this apparatus consist in that each drop produces a marking spot or "island" which is completely without connection to the other spots or "islands" so that rain water can run away; it works without templates; and the applied marking adheres extremely well to the road due to the blow-like application.

The area of the marking spots will normally amount to 20% or less of the total area of the traffic indication line. Each spot will typically have a diameter of 10–15 mm and a height of 2–5 mm. The side walls of each spot will be substantially vertical, this giving rise to a maximum reflex-reflecting effect.

A mechanical embodiment is characterized by the fact that the orifice zones of the conduits are placed on a cylinder surface and are mutually separated by means of partition walls and that the means for flinging the material down into engagement with the road comprise a rotatory shaft and a number of shovel blades.

A pneumatic embodiment is characterized by the fact that the means for flinging the drops down into engagement with the road comprise a plurality of compressed air tubes each leading to an orifice zone and another plurality of tubes leading away from the said zone.

These apparatus constitute simple and cheap embodiments of an apparatus which effectively flings the marking mass into contact with the road.

The invention will be further explained in connection with the drawings in which:

FIGS. 1 and 2 are schematic drawings illustrating a mechanical embodiment of the invention, FIG. 3 a vertical section through the principal parts of the same apparatus, some parts having been omitted, FIG. 4 the same in a horizontal section, FIG. 5 a schematic drawing illustrating a pneumatic embodiment, and FIG. 6 schematically the whole apparatus irrespective of the specific embodiment.

FIGS. 1 and 2 illustrate, in two different situations, how a mechanical apparatus (FIG. 6) for applying a highly viscous marking mass M comprising a reservoir R, a nozzle section 10 and wheels W is moved horizontally over a road 1 by means of known and not shown conveying means.

The mass M is fed through canals, of which a single canal 11 is shown, by means of the necessary pressure.

At the orifice zone 11' of each nozzle-formed canal 11 in the nozzle head 10 there is formed a preliminary stage of a drop M' which due to high viscosity of the mass will not be released by itself. The preliminary stage of the drop M' is wiped off the orifice zone 11' of the canal 11 by means of a rotatory applying means 20 having a shaft 21 and shovel blades 22 of which a single one is shown in FIGS. 1 and 2 (and in FIG. 3) and is flung to the road 1.

Due to the speed with which it is flung onto the road the material mass will be compressed. By varying the feeding speed $V_1$ of the mass one can control the size of the drops M'' of the mass. By varying the speed of rotation $V_2$ of the means 20 one can vary the number of material drops at the driving speed $V_3$ of the apparatus.

As an example, the distance between the drops may be 25 mm, and the size of the drops on the road about 10 mm, which means to say that there will be about 30 drops per meter or 50 material drops applied per second at a driving speed of 6 km per hour.

FIGS. 3 and 4 show in a vertical and a horizontal section, respectively, the nozzle head 10 with canals 11, through which the mass M is fed under pressure, and the applying means 20 having a rotatory shaft 21 and seven pairs of shovel blades 22 of which only a single one is shown in FIG. 3 in order not to complicate the drawing.

As will appear from FIG. 4, partition walls 13 are placed between the orifices of the nozzle-formed canals 11, these orifices being placed on a cylinder surface 12 (FIG. 3).

The necessary driving means are omitted in order not to complicate the drawing.

FIG. 5 shows a pneumatic embodiment with a nozzle section 10' in which the canals 11 lead to orifice zones 11'' from which the preliminary stages of drops are flung into engagement with the road 1 through a tube 20'', impulses of compressed air being administered at regular intervals of typically 20–30 milliseconds through a tube 20'. The accessory equipment can easily be provided by a man skilled in the art.

The number of nozzles correspond to the width of the traffic indication line desired. The distance between the nozzles is normally 15 mm.

The marking mass used may for instance have the following composition:

EXAMPLE 1:

| | |
|---|---|
| Binder (methacrylic resin) | 21,5% |
| Titanium dioxide | 12,5% |
| Calcined flint 0-25μ | 21% |
| Calcined flint 0,1-1,0 mm | 20% |
| Reflex beads | 25% |

to which may be added a little silica powder for controlling the viscosity.

EXAMPLE 2

| | |
|---|---|
| Binder | 22% |
| Titanium dioxide | 8% |
| Chalk | 20% |
| Reflex beads | 30% |
| Calcined flint | 20% |

to which may be added a little silica powder for controlling the viscosity.

The temperature is approximately that of the surroundings, for instance 25° C. The pressure is 2,5-7 bar depending upon the viscosity of the mass. A higher pressure will give rise to a drop of marking material on the road having a more flat configuration than in case of a lower pressure.

I claim:

1. Apparatus for applying blobs of viscous marking liquid to a ground surface comprising a wheeled vehicle adapted to traverse the surface, the vehicle including a reservoir for the marking liquid with a liquid outlet, pressure means for continuously forcing liquid from the reservoir through the outlet, and liquid flinging means externally of the reservoir for applying intermittent propelling forces to liquid issuing from the outlet for repetitively shearing blobs of material from the liquid and flinging the blobs onto said surface.

2. The invention of claim 1 wherein the vehicle includes a concave vertically extending wall defining said outlet and the liquid flinging means comprises a rotor on a substantially horizontal axis and blade means on the rotor for wiping the said wall on rotation of the rotor thereby repetitively shearing the blobs of material from the liquid and flinging the blobs onto said surface.

3. The invention of claim 1 wherein the vehicle includes a vertically extending open-bottom pressure tube, said outlet opening into said tube, and the flinging means comprising means for providing repetitive pneumatic pressure pulses downwardly through said tube.

4. The invention of claim 1 wherein the outlet and flinging means are replicated across the width of the vehicle.

* * * * *